US005865049A

United States Patent [19]

Friedrich et al.

[11] Patent Number: 5,865,049

[45] **Date of Patent: *Feb. 2, 1999**

[54] HALL-EFFECT KEY-POSITION SENSOR FOR MOTOR-VEHICLE LATCH

[75] Inventors: Hagen Friedrich, Essen; Andreas Siekierka, Recklinghausen; Thorsten Torkowski, Duisburg, all of Germany

[73] Assignee: Kiekert AG, Heiligenhaus, Germany

[ * ] Notice: The term of this patent shall not extend beyond the expiration date of Pat. No. 5,862,691.

[21] Appl. No.: 915,897

[22] Filed: Aug. 21, 1997

[30] Foreign Application Priority Data

Aug. 24, 1996 [DE] Germany ..... 196 34 321.6
Jan. 23, 1997 [DE] Germany ..... 197 02 206.5

[51] Int. Cl.[6] ..... E05B 47/00

[52] U.S. Cl. ..... 70/264; 70/276; 70/DIG. 30; 340/426; 340/542

[58] Field of Search ..... 70/264, 276, 413, 70/DIG. 30; 340/426, 542

[56] References Cited

U.S. PATENT DOCUMENTS

| | | | |
|---|---|---|---|
| 3,124,950 | 3/1964 | Nallinger | 70/264 |
| 4,399,673 | 8/1983 | Gotanda | 70/276 |
| 4,565,994 | 1/1986 | Mochida et al. | 340/542 |
| 4,910,980 | 3/1990 | Katoh | 70/264 X |
| 5,551,267 | 9/1996 | Janssen et al. | 70/276 X |
| 5,566,562 | 10/1996 | Fujii | 70/276 X |

FOREIGN PATENT DOCUMENTS

| | | | |
|---|---|---|---|
| 0 447 818 | 9/1991 | European Pat. Off. . | |
| 2821901 | 12/1978 | Germany | 70/264 |
| 3941086 | 6/1991 | Germany | 70/276 |
| 94 15 257 | 1/1995 | Germany . | |
| 2187227 | 9/1987 | United Kingdom | 70/277 |
| WO 90/07045 | 6/1990 | WIPO | 70/276 |

*Primary Examiner*—Lloyd A. Gall
*Attorney, Agent, or Firm*—Herbert Dubno; Andrew Wilford

[57] ABSTRACT

A lock system has a lock cylinder pivotal about an axis between a pair of end positions and through a center starting position, a key fittable into the cylinder and actuatable to pivot the cylinder between its positions, an arcuate magnet centered on the axis and coupled to the cylinder for joint movement therewith, and a pair of angularly spaced Hall-effect sensors adjacent the magnet, trippable by the magnet to generate respective outputs, and positioned such that in the central position the magnet is closely juxtaposed with and trips both sensors, in one of the end positions the magnet is closely juxtaposed with and trips only one of the sensors and is spaced from the other of the sensors, and in the other end position the magnet is closely juxtaposed with and trips only the other sensor and is spaced from the one sensor. The sensors and magnet are so constructed and relatively positioned that on pivoting of the magnet through a predetermined angle in one direction from the center position the one sensor is tripped and on pivoting of the magnet through the predetermined angle in the other direction the other sensor is not tripped. A lock system connected to the sensors has an antitheft mode initiated by the sensors on displacement of the cylinder into the antitheft end positions and provided with a latch operable on displacement of the cylinder into the lock/unlock end position.

11 Claims, 2 Drawing Sheets

HALL-EFFECT KEY-POSITION SENSOR FOR MOTOR-VEHICLE LATCH

FIELD OF THE INVENTION

The present invention relates to a motor-vehicle door latch. More particularly this invention concerns a sensor exploiting the Hall effect to determine the position of the key of such a latch.

BACKGROUND OF THE INVENTION

A standard motor-vehicle door latch system has at least one key-operated cylinder, a plurality of latches one of which is directly operated by the cylinder, and a central controller. In a sophisticated modern system the key is movable from a center position to one side to lock or unlock the door and to the other side to set the system in an antitheft mode. The controller normally unlocks, but does not unlatch, the other latches when the key-operated latch is unlocked. In the antitheft position the central controller blocks operation of all the latches so the respective doors cannot even be opened from inside the vehicle. The advantage of such a system is that the doors can be securely locked from one location and that, as in a standard power-lock arrangement, all the doors can similarly be unlocked from this one location.

In European patent 0,447,818 of K. Claar (based on a German priority of 20 Mar. 1990) a system is described which uses Hall-effect sensors to ascertain the key position, eliminating a direct mechanical link. Such an arrangement uses a sensor of the type described in German utility model 9,415,257 published 5 Jan. 1995 to detect the key position. Such a sensor incorporates circuitry so that when a magnetic-field of a strength exceeding a predetermined threshold passes through it, the sensor is tripped to generate an output. Unfortunately such an arrangement is susceptible of manipulation, for instance by a would-be thief who can hold a large permanent magnet against the vehicle door to actuate the device and open the vehicle.

Thus commonly owned patent application Ser. No. 08/902,469 filed 29 Jul. 1997 describes a motor-vehicle door-latch system that has a key cylinder pivotal about an axis from a center starting position into a pair of opposite end positions flanking the center position, a key insertable into the cylinder only in the starting position thereof, a latch operable by the cylinder on displacement of same into one of the end positions, and an arcuate magnet pivotal about the axis, polarized generally parallel to the axis, and coupled to the cylinder for joint angular movement therewith. A pair of Hall-effect sensors are juxtaposed with the magnet and positioned such that in the central position the magnet is closely juxtaposed with both sensors, in the one end position the magnet is closely juxtaposed with one of the sensors and is spaced from the other of the sensors, and in the other end position the magnet is closely juxtaposed with the other sensor and is spaced from the one sensor. A lock system connected to the sensors has an antitheft mode initiated by the sensors on displacement of the cylinder into the other of the end positions.

This system will respond very accurately to the position of the arcuate magnet, but will be difficult to fool. If a would-be thief simply applies a large magnet to the area of the sensors, it will not be possible to duplicate the condition of only one of the sensors being traversed by the magnetic field of the system's magnet. In fact according to another feature of the invention the lock system is set to respond, normally by generating an alarm and/or setting the antitheft position, when such tampering is detected, as when neither of the sensors is traversed by the magnet's field. Thus in an attempt to overcome the system by judicious application of a magnetic field, the would-be thief is far more likely to trip the alarm than to open the latches controlled by the lock system.

While this system is relatively effective, it is still possible for it to be circumvented by carefully positioning a magnet on the key-position sensor. Admittedly this is fairly difficult, but is possible for a skilled thief.

OBJECTS OF THE INVENTION

It is therefore an object of the present invention to provide an improved Hall-effect key-position sensor for a motor-vehicle door latch.

Another object is the provision of such an improved Hall-effect key-position sensor for a motor-vehicle door latch which overcomes the above-given disadvantages, that is which is harder to trip by external application of a magnet than the above-described prior-art systems.

SUMMARY OF THE INVENTION

A lock system has according to the invention a lock cylinder pivotal about an axis between a pair of end positions and through a center starting position, a key fittable into the cylinder and actuatable to pivot the cylinder between its positions, an arcuate magnet centered on the axis and coupled to the cylinder for joint movement therewith, and a pair of angularly spaced Hall-effect sensors adjacent the magnet, trippable by the magnet to generate respective outputs, and positioned such that in the center position the magnet is closely juxtaposed with and trips both sensors, in one of the end positions the magnet is closely juxtaposed with and trips only one of the sensors and is spaced from the other of the sensors, and in the other end position the magnet is closely juxtaposed with and trips only the other sensor and is spaced from the one sensor. The sensors and magnet are so constructed and relatively positioned that on pivoting of the magnet through a predetermined angle in one direction from the center position the one sensor is tripped and on pivoting of the magnet through the predetermined angle in the other direction from the center position the other sensor is not tripped. A lock system connected to the sensors has an antitheft mode initiated by the sensors on displacement of the cylinder into the antitheft end positions and provided with a latch operable on displacement of the cylinder into the lock/unlock end position.

Normally it is the antitheft sensor that is set to trip first so that if the system is exposed to a powerful magnet in an attempt to gain unauthorized entry, the result will be to set the system in the antitheft mode. This ensures that the lock system is set in its most secure mode.

The invention is based on the recognition that a system with two Hall-effect sensors can be set up so that when another magnet is juxtaposed with the device, the system will not respond by unlocking, but instead will respond by staying solidly locked. In fact the system can easily be set to emit an alarm on detecting such tampering. This effect is easily obtained by setting the trip thresholds of the sensors at different levels, making one part of the magnet stronger than the other, or by spacing one of the sensors farther from the magnet than the other.

According to the invention the magnet is laminated and has one axially directed face constituting a north pole and an opposite axially directed face constituting a south pole. In one arrangement the magnet is formed as a flat arcuate bar lying generally in a plane perpendicular to the axis. It can also be formed as a part cylinder centered on the axis.

BRIEF DESCRIPTION OF THE DRAWING

The above and other objects, features, and advantages will become more readily apparent from the following description, to reference being made to the accompanying drawing in which.

SPECIFIC DESCRIPTION

Figure 1:
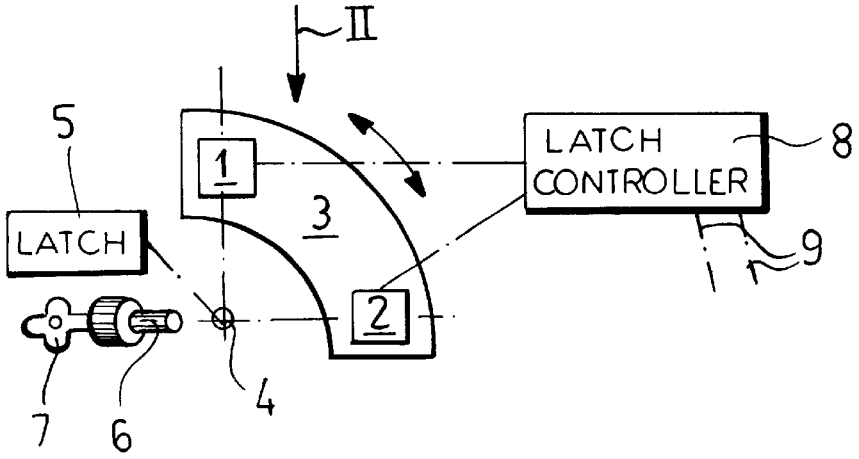
FIG. 1 is a largely diagrammatic side view of the key-position sensor system of this invention in the starting position.
Figure 2:
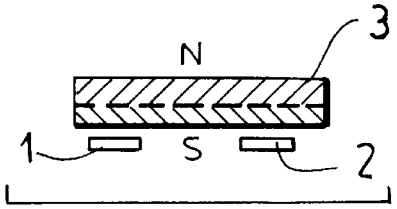
FIG. 2 is a top view taken in the direction of arrow II of FIG. 1.
Figure 4:
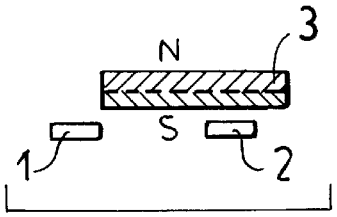
FIGS. 4 and 5 are views like FIG. 2 but respectively showing the sensor system in the lock/unlock and antitheft positions.
Figure 5:
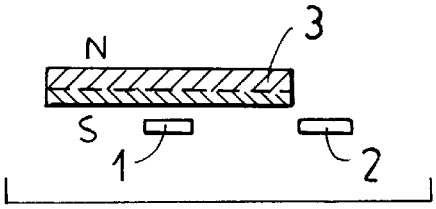

As seen in FIGS. 1 and 2 a lock system according to the invention has a cylinder 6 rotatable about an axis 4 by a key 7 and connected to a standard mechanical door latch 5. A laminated permanent magnet 3 formed as a 90° flat bar is centered on and pivotal about the axis 4 adjacent a pair of Hall-effect sensors 1 and 2 connected to a latch controller 8 that is connected to the latch 5 and also via connections 9 to other unillustrated door latches. The sensor 1 serves to lock or unlock the various latches and the sensor 2 serves to set the system in the antitheft mode. The key 7 can normally only be inserted into and withdrawn from the cylinder in a center position illustrated in FIGS. 1 and 2 in which the magnet 3 is closely juxtaposed with and trips both sensors to generate their respective outputs. In one end position shown in FIG. 4 the magnet 3 is closely juxtaposed with the antitheft sensor 2 and not with the sensor 1 and in the other end position shown in FIG. 5 the situation is reversed.

The controller 8 is set up to lock up the entire system, normally by locking all the latches and putting the system in the antitheft mode when tampering is detected. For instance if a magnetic field is applied with the magnet 3 in the starting position that cancels out the field of the magnet 3, the controller will lock up the system.

Figure 3:
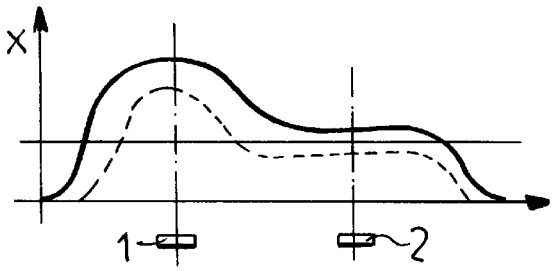
FIG. 3 is a diagram illustrating operation of the system.

As illustrated in FIG. 3, the system of FIGS. 1 through 5 is set up so that the antitheft sensor 2 is tripped to generate its output when traversed by a magnetic flux of a lower density than that which trips the sensor 1. This can be done either by actually setting the response threshold in the circuitry of the sensors 1 and 2, or simply by setting the sensor 1 closer axially to the magnet 3 than the sensor 2. In FIG. 3 the abscissa shows the angular travel of the magnet 3 and the ordinate the response threshold. The advantage of this is that if, for example, a person applies a powerful magnet to the door to trick the system into interpreting the field as being the magnet 3 in the central position, in fact the sensor 1 will respond before the sensor 2, indicating outside manipulation in which case the controller 8 will shut down the system.

Figure 6:
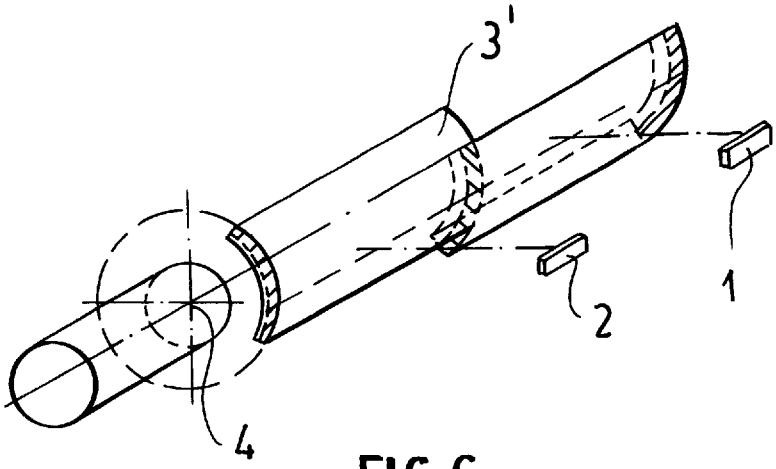
FIG. 6 is a perspective view of another system according to the invention.
Figure 7:
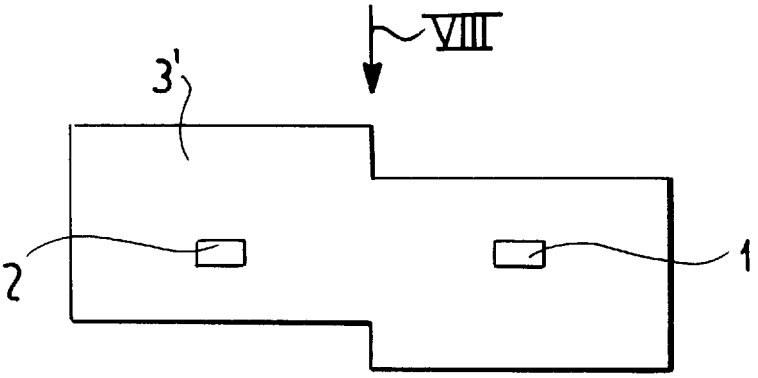
FIG. 7 is a developed view of the system of FIG. 6.
Figure 8:
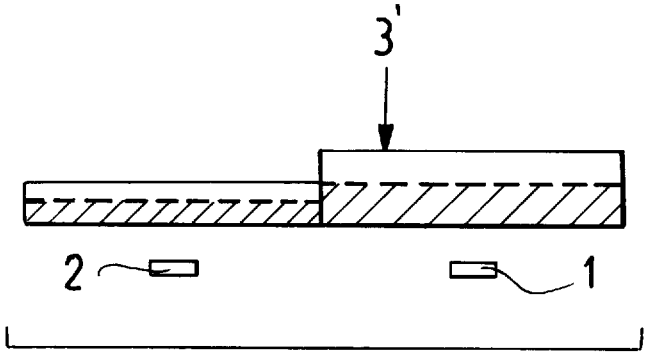
FIG. 8 is a side view taken in the direction of arrow VIII of FIG. 7.

In the arrangement in FIGS. 6 through 8 the magnet 3' is formed as a stepped part-cylindrical body of laminated magnet structure with its portion juxtaposed with the sensor 1 much thicker than that juxtaposed with the sensor 2 so that it has a greater magnetic flux density. The result is that, even if the sensors 1 and 2 are set to trip when traversed by a field of the same flux density, the sensor 1 will be tripped before the sensor 2 as the magnet 3' rotates about axis 4 adjacent it. Thus if a large magnet is positioned adjacent the system, the sensor 2 will respond first as the flux density of the thinner part of the magnet 3' will be overcome more easily. Once again this will indicate to the controller 8 that something unauthorized is going on and the system will be shut down.

Each sensor normally comprises a standard Hall-effect wafer imbedded in a plastic body which also carries circuitry, such as an amplifier, comparator, and switching elements, that establish the threshold at which the sensor is tripped. Such sensors are standard in the art.

We claim:

1. A lock system comprising:

a lock cylinder pivotal about an axis between a lock/unlock end position, an antitheft end position, and through a center starting position;

a key fittable into the cylinder and actuatable to pivot the cylinder between its positions;

an arcuate magnet centered on the axis and coupled to the cylinder for joint movement therewith;

a pair of spaced Hall-effect sensors adjacent the magnet, trippable by the magnet to generate respective outputs, and positioned such that in the center position the magnet is closely juxtaposed with and trips both sensors, in one of the end positions the magnet is closely juxtaposed with and trips only one of the sensors and is spaced from the other of the sensors, and in the other end position the magnet is closely juxtaposed with and trips only the other sensor and is spaced from the one sensor, the sensors and magnet being so constructed and relatively positioned that on pivoting of the magnet through a predetermined angle in one direction from the center position the one sensor is tripped and on pivoting of the magnet from the center position through the predetermined angle in the other direction the other sensor is tripped but the one sensor is not tripped; and a lock system connected to the sensors and having an antitheft mode initiated by the sensors on displacement of the cylinder into the antitheft end positions and provided with a latch operable on displacement of the cylinder into the lock/unlock end position.

2. The lock system defined in claim 1 wherein the sensors are angularly spaced.

3. The lock system defined in claim 1 wherein the sensors are axially spaced.

4. The lock system defined in claim 1 wherein the one sensor is more sensitive to a magnetic flux of the magnet than the other sensor.

5. The lock system defined in claim 1 wherein the sensors are of similar sensitivity and the magnet has one side with greater magnetic-flux density than an other side.

6. The lock system defined in claim 1 wherein the one sensor is closer to a plane perpendicular to the axis than the other sensor.

7. The lock system defined in claim 1 wherein the magnet is laminated and has one axially directed face constituting a north pole and an opposite axially directed face constituting a south pole.

8. The lock system defined in claim 7 wherein the magnet is formed as a flat arcuate bar lying generally in a plane perpendicular to the axis.

9. The lock system defined in claim 7 wherein the magnet is formed as a part cylinder centered on the axis.

10. A lock system comprising:

a lock cylinder pivotal about an axis between a lock/unlock end position, an antitheft end position, and through a center starting position;

a key fittable into the cylinder and actuatable to pivot the cylinder between its positions;

an arcuate magnet centered on the axis and coupled to the cylinder for joint movement therewith;

a pair of spaced Hall-effect sensors adjacent the magnet, trippable by the magnet to generate respective outputs, and positioned such that in the center position the magnet is closely juxtaposed with and trips both sensors, in one of the end positions the magnet is closely juxtaposed with and trips only one of the sensors and is spaced from the other of the sensors, and in the other end position the magnet is closely juxtaposed with and trips only the other sensor and is spaced from the one sensor, the sensors being of different sensitivity such that on pivoting of the magnet through a predetermined angle in one direction from the center position the one sensor is tripped and on pivoting of the magnet through the predetermined angle in the other direction the other sensor is tripped; and a lock system connected to the sensors and having an antitheft mode initiated by the sensors on displacement of the cylinder into the antitheft end position and provided with a latch operable on displacement of the cylinder into the lock/unlock end position.

11. A lock system comprising:

a lock cylinder pivotal about an axis between a lock/unlock end position, an antitheft end position, and through a center starting position;

a key fittable into the cylinder and actuatable to pivot the cylinder between its positions;

an arcuate magnet centered on the axis and coupled to the cylinder for joint movement therewith;

a pair of spaced Hall-effect sensors adjacent the magnet, trippable by the magnet to generate respective outputs, and positioned such that in the center position the magnet is closely juxtaposed with and trips both sensors, in one of the end positions the magnet is closely juxtaposed with and trips only one of the sensors and is spaced from the other of the sensors, and in the other end position the magnet is closely juxtaposed with and trips only the other sensor and is spaced from the one sensor, the magnet having a portion of greater flux density and a portion of lesser flux density such that on pivoting of the magnet through a predetermined angle in one direction from the center position the one sensor is tripped and on pivoting of the magnet through the predetermined angle in the other direction the other sensor is tripped; and a lock system connected to the sensors and having an antitheft mode initiated by the sensors on displacement of the cylinder into the antitheft end position and provided with a latch operable on displacement of the cylinder into the lock/unlock end position.

* * * * *